United States Patent [19]

Mol

[11] 3,997,154

[45] Dec. 14, 1976

[54] STACKING SYSTEM FOR A ROTARY DRUM COLLATOR

[75] Inventor: Hans C. Mol, Wilton, Conn.

[73] Assignee: Pitney-Bowes, Inc., Stamford, Conn.

[22] Filed: Oct. 20, 1975

[21] Appl. No.: 623,626

[52] U.S. Cl. ..... 271/215; 93/93 DP; 214/6 N; 270/58; 271/217; 271/224

[51] Int. Cl.[2] ..... B65H 31/08; B65H 33/08

[58] Field of Search ..... 214/6 N; 271/224, 223, 271/217, 215, 239, 262, 64, 263, 173; 270/58; 93/93 DP

[56] References Cited

UNITED STATES PATENTS

| | | | |
|---|---|---|---|
| 2,228,887 | 1/1941 | Peterson | 93/93 DP |
| 2,839,295 | 6/1958 | Bernard | 271/224 |
| 3,179,403 | 4/1965 | Gagg | 271/263 |
| 3,578,159 | 5/1971 | Lindquist et al. | 271/215 X |

*Primary Examiner*—John J. Love
*Assistant Examiner*—Bruce H. Stoner, Jr.
*Attorney, Agent, or Firm*—William D. Soltow, Jr.; Albert W. Scribner; Robert S. Salzman

[57] ABSTRACT

An improved stacking system for a collar is disclosed. The stacking system comprises a unique three-position off-set stacking apparatus that provides a third off-set stack position for improperly collated sets. The improperly collated sets are delivered to a third off-set position when a miss or a double feed is detected. Two stop members are moved to an inactive position in response to the double or miss detection, thus allowing a third stop member to provide a third off-set position for the improperly collated stack.

8 Claims, 6 Drawing Figures

FIG. 2
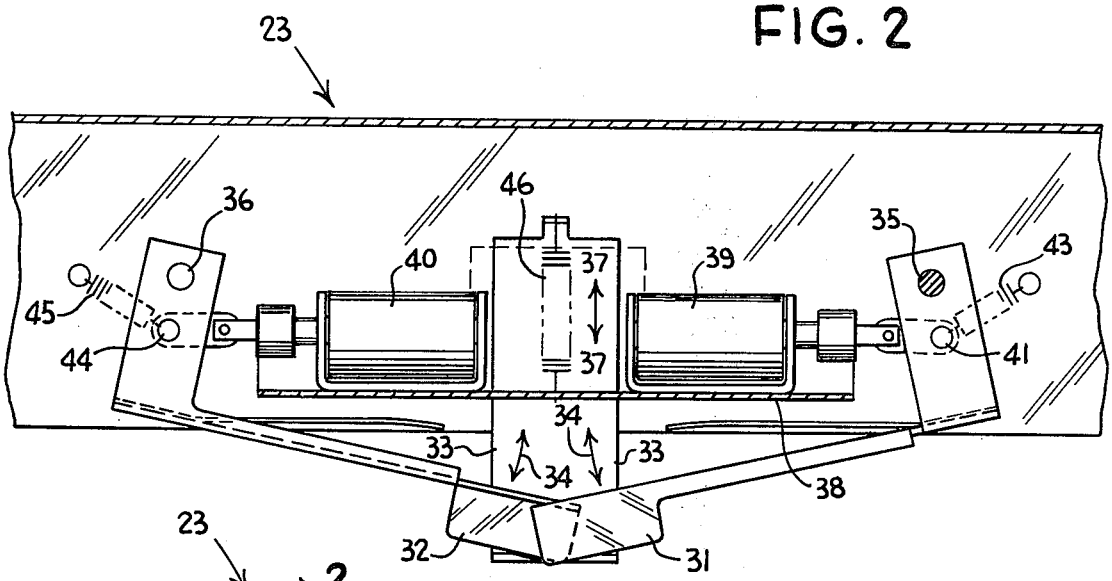
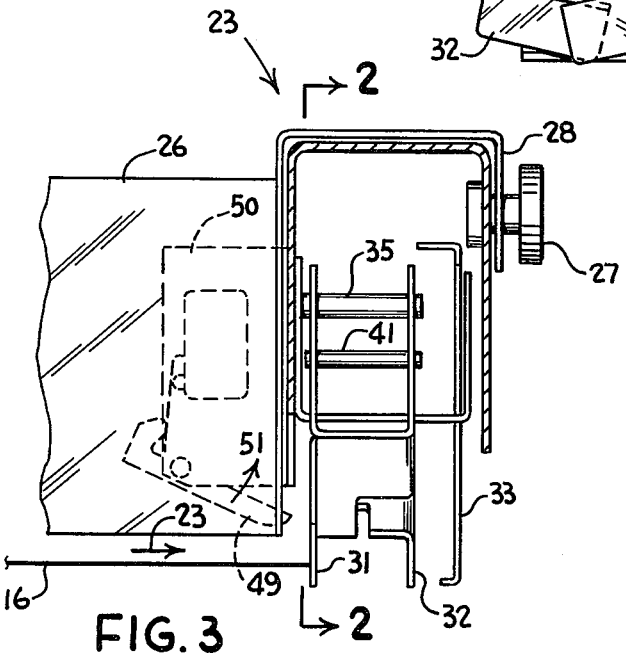
FIG. 3
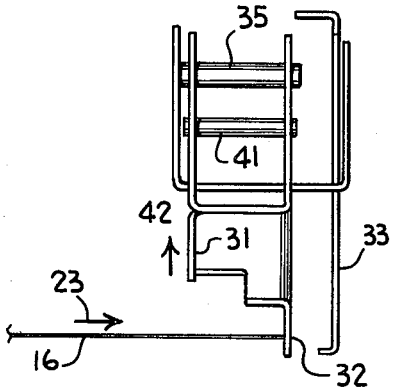
FIG. 3a
FIG. 3b
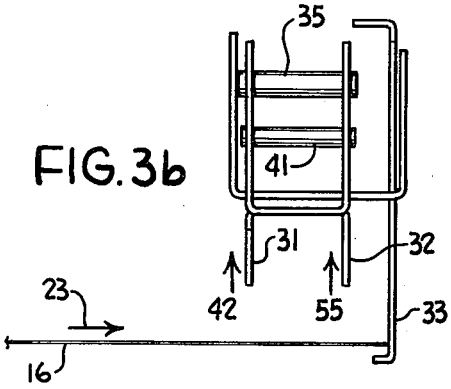
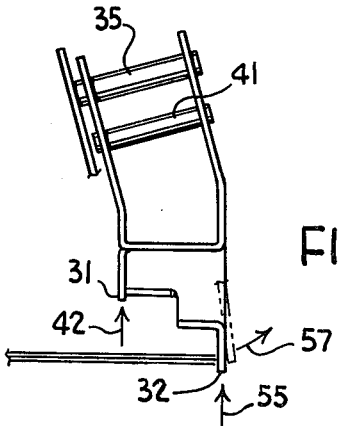
FIG. 3c

STACKING SYSTEM FOR A ROTARY DRUM COLLATOR

This invention pertains to improvements in a collating machine, and more particularly to an improved off-set stacking system for use with, but not exclusively for, a rotary drum collator of the type disclosed and described in application Ser. No. 419,900, filed Oct. 29, 1973.

BACKGROUND OF THE INVENTION

Heretofore, collators have been operated in such a fashion that detection of a missed sheet, or a doubly fed sheet, would require stoppage of the machine.

Naturally, when a machine is stopped due to a malfunction, a great deal of time is spent in resetting and rerunning the apparatus. Also, if a machine will automatically cease to function, an attendant must always be ready to service the apparatus in anticipation of a shut-down.

A better way to operate the collator is to have a continuous run until the end of the cycle. The problem with this type of operation, however, is that it requires some means of separating an improperly collated set from the majority of properly collated sets.

The present invention has provided a means of allowing a collator to have a continuous collator run despite feeding mistakes, by off-setting improperly collated stacks of sheet material to a third (improper) stack position.

SUMMARY OF THE INVENTION

The invention relates to a stacking system for a collator having three off-set stacking positions. The stacking system has a stacking deck for receiving sheets of material from a sheet dispensing means such as a rotary drum. The deck supports the sheets in off-set stacks. Sensing means is disposed along a feed path between the sheet dispensing means (rotary drum) and the deck. The sensing means senses an improper feed condition. A three-position stop means is disposed adjacent the stacking deck. This stop means stops incoming sheets being received by the deck and positions them in off-set stacks. The stop means comprises first and second stop members that are each respectively movable between a stopping and a non-stopping sheet position. The second stop member is mounted behind the first stop member to stop the sheets when the first stop member is in a non-stopping sheet position. The first and second stop members are operatively connected and responsive to the sensing means. When the sensing means senses an improper feed condition, both the first and second stop members will be in their respective non-stopping sheet positions. A third stop member will stop the sheets, when the first and second stop members are in their non-stopping positions.

It is an object of this invention to provide an improved stacking system for a collator;

It is another object of the invention to provide a stacking system for a collator that allows for continuous cycling of the collator despite improper feed conditions;

It is a further object of this invention to provide a stacking system for a collator that has a third off-set position for improperly collated stacks.

These and other objects of the invention will become more apparent and will be better understood with reference to the following detailed description taken in conjunction with the accompanying drawings, in which:

FIG. 2 is a frontal internal view of the off-set stopping mechanism of the stacking system of FIG. 1;

FIG. 3 is a side view of the internal structure of FIG. 2;

Figure 1:
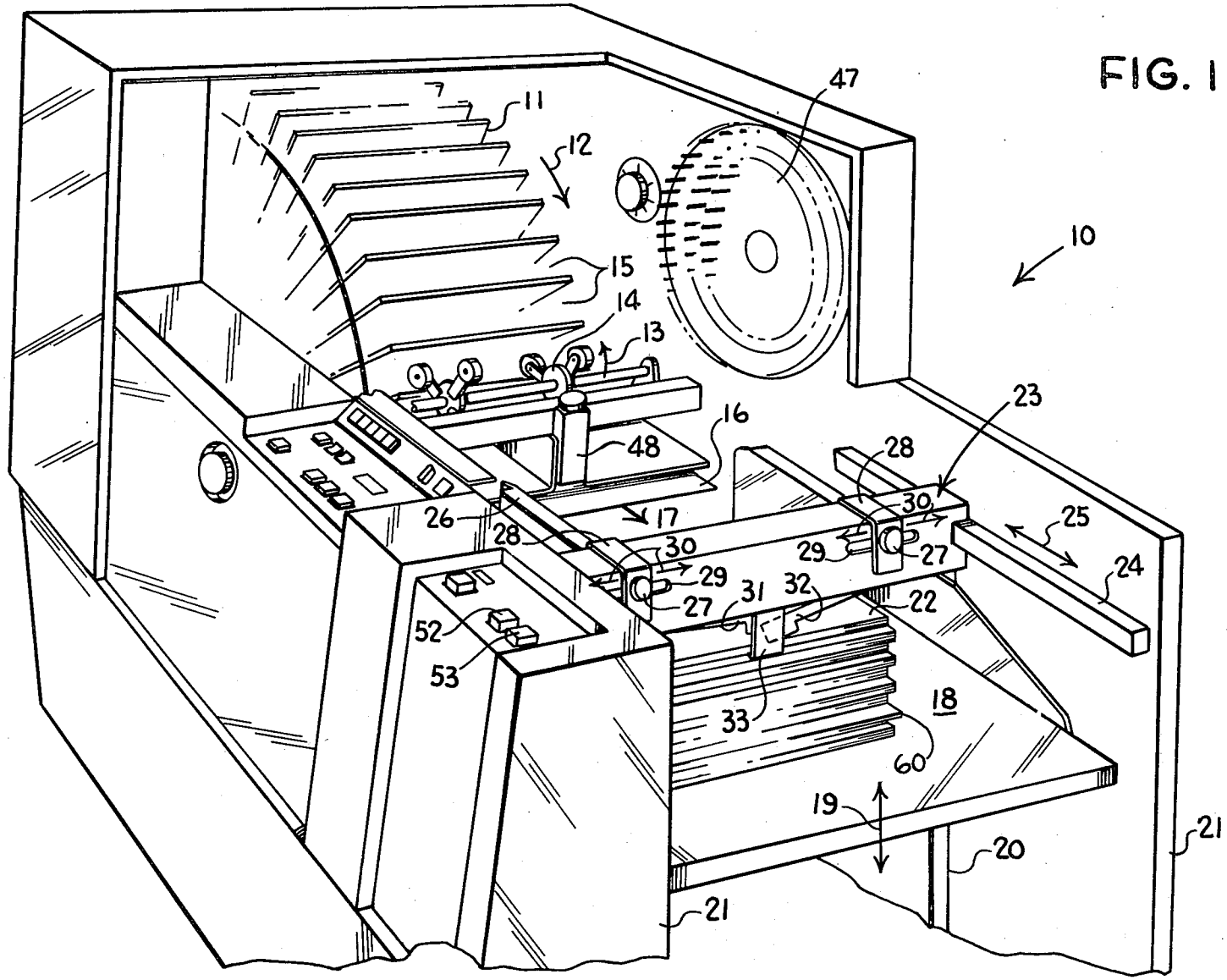
FIG. 1 is a perspective, in situ view of the stacking system of this invention.

FIG. 3*a* is a sectional view of FIG. 3 taken along lines 3—3, showing an alternate stop position to that illustrated in FIG. 3;

FIG. 3*b* is a similar view to that of FIG. 3*a* depicting a third stop position for the stopping mechanism; and FIG. 3*c* is a view of an alternate embodiment of the apparatus shown in FIG. 3*a*.

Now referring to FIG. 1, a perspective in situ view of the stacking system of this invention is shown.

A rotary drum collator is generally illustrated by the arrow 10. This type of collator is disclosed and described in patent application Ser. No. 419,900; filed Oct. 29, 1973. Unless mentioned otherwise, the collator of this invention operates and is structured in the same manner as the prior machine.

The collator 10 has a rotating drum 11, that synchronously meshes (arrow 12) with a rotating (arrow 13) sheet withdrawing roller set 14 (spider).

Sheets of material are stored in the pockets 15 of the drum 11. Sheets within pockets 15 are withdrawn by means of the roller set 14. Each sheet 16 which is withdrawn from a pocket 15 is discharged (arrow 17) to a stacking deck 18. The deck 18 is vertically movable (arrows 19) within guides 20 (only one shown) in the frame walls 21.

Discharging sheets 16 are conveyed to the deck 18, where they are stacked (sets of stacks 22) in an off-set manner.

A sheet stopping mechanism is generally shown by arrow 23. The stopping mechanism 23 is movably supported on guide bars 24 (only one shown) secured to frame walls 21. The stopping mechanism 23 is slidable (arrows 25) along bars 24 to provide a longtitudinal exit adjustment for discharging sheets 16.

Guide plates 26 are adjustably secured to the stopping mechanism 23 to provide a supportive guide to discharging sheets 16. The plates 26 are supported by respective straps 28 which are adjustably secured to the stopping mechanism 23 by thumb nuts 27 (see FIGS. 1 and 3). A lateral slot 29 allows each guide plate 26 to be slidably moved (arrows 30, FIG. 1) upon the stopping mechanism 23, so as to constrict or expand the discharge throat of the stacking area (lateral exit adjustment).

The stopping mechanism 23 has three movable stop members 31, 32 and 33, respectively, for providing three off-set positions for the discharged sheets 16.

With reference to FIG. 2, stop members 31 and 32 are respectively pivotable (arrows 34) about shafts 35 and 36, respectively. Stop member 33 is slidably movable (arrows 37) within a slot (not shown) disposed within bracket 38.

Solenoid 39 is pinned to stop member 31 by pin 41. When solenoid 39 is actuated, the stop member 31 is caused to pivot upwardly (arrow 42) as depicted in FIG. 3*a*. A spring 43 (FIG. 2) causes the stop member 31 to return to its initial stopping position, when the solenoid 39 is deactuated.

Solenoid 40 is pinned to stop member 32 by pin 44. When solenoid 40 is actuated, the stop member 32 is caused to pivot upwardly similar to that of stop member 31. A spring 45 causes the stop member 32 to return to its rest (stopping) position, when the solenoid 40 is deactuated.

Stop member 33 is not solenoid controlled, but is manually slidable (arrows 37). Spring 46 biases stop member 33 to a downward stopping position.

With reference again to FIG. 1, a programming disc 47 is shown in the side wall 21 of the collator 10. This programming disc controls the collating cycle of the drum 11, and actuates and deactuates solenoid 39 (FIG. 2) to alternately raise and lower stop member 31. This provides for off-setting each stack of sheets (set) with every new collating cycle (There may be more than one collating cycle for each drum revolution depending on the size of the stack set).

A combination miss and doubles detector 48 senses the feeding condition of sheets 16 passing below. When an improper feed condition is sensed, detector 48 actuates solenoids 39 and 40 (FIG. 2) to pivot stop members 31 and 32 upwardly to a non-stopping position (FIG. 3*b*).

Now referring to FIG. 3, a lever 49 is shown pivotably mounted to a normally closed switch 50. When the incoming (arrow 23) sheets 16 are delivered to the deck 18, they will become stacked upon the deck. As the height of the sheets increase, they will press upwardly against the lever 49. The lever 49 will then be caused to pivot (arrow 51), thus closing switch 50. When the switch 50 is closed, a motor (not shown) is actuated to lower (arrow 19; FIG. 1) the deck. The deck will only lower a small incremental distance, because as the deck moves downwardly, the pressure is relieved against lever 49, and the switch 50 is caused to open again. Thus, it will be observed, that the deck 18 will be periodically lowered as each succeeding sheet build-up actuates switch 50, and each incremental lowering of the deck 18 will relieve switch 50 to allow for a subsequent sheet build-up.

A pair of push-button switches 52 and 53, respectively, depicted in FIG. 1, are also provided for raising or lowering (arrows 19) the deck 18. The switch 52 for raising the deck is needed at the end of each collator run, for returning the deck to its initial home position. Both switches 52 and 53 can be used as an aid to removing stacks from the deck, or for inspecting a given stack condition or quantity.

OPERATION OF THE INVENTION

The operation of the stacking system of this invention will be described with particularly reference to FIGS. 3, 3*a* and 3*b*.

As aforementioned, every revolution of the drum will provide at least one complete collated stack of sheets (set). More than one stack set may be obtained in a drum revolution by using the remaining pockets to load an additional stack set. There will be only one stack of sheets per drum revolution, if the number of drum pockets required to make a complete stack set requires more than half of the drum pockets. Each collated stack is required to be off-set from a prior stack, and a subsequent stack. This is accomplished by alternating stop member 31 (for each collating cycle) between a lower sheet stopping position as shown in FIG. 3, and an upper sheet non-stopping position depicted in FIG. 3*a*. Naturally, when the stop member 31 is in the raised position, the collated stack will comprise sheets 16 whose forward travel (arrow 23) has been terminated by stop member 32 (FIG. 3*a*). Thus, when the programming disc 47 of FIG. 1, initiates a new collating cycle, a new stack off-set position is achieved by actuation or deacctuation of solenoid 39 (as the case may be). The cyclic actuation or deactuation of solenoid 39, will pivot (arrow 34) stop member 31 between the stopping and non-stopping sheet positions, as aforementioned. The alternating actuation and deactuation of solenoid 39 is operatively controlled by the programming disc 47 with the initiation of each new collating cycle, as previously stated.

In the event of an improper feed condition, a third off-set position is provided for the improperly collated stack as can be seen with reference to FIG. 3b and stack set 60 of FIG. 1. The incoming sheets 16 of an improperly collated stack will be stopped by the third stop member 33. In such a case (FIG. 3*b*) both stop members 31 and 32 are respectively raised (respective arrows 42 and 55) to their upper non-stopping position. This is achieved by actuating both solenoids 39 and 40 (FIG. 2). Naturally, if the solenoid 39 is already actuated by programming disc 47, it will just remain actuated, i.e. it will not require reactuation.

The actuation of both solenoids 39 and 40, as aforementioned, is controlled by the feed sensor 48 of FIG. 1. When an improper feed condition is sensed by sensor 48, such as when there is a mis-feed, the sensor 48 will actuate solenoids 39 and 40. This will then provide for a third off-set position for the sheets of this misformed stack.

The sensor 48 of this invention also comprises a multiple feed (doubles) detector, as well as a missed sheet detector. Other detectors are obviously capable of being included or combined within the general detection scheme of sensor 48. Any improper feed condition that will produce an incomplete or improperly collated stack, is meant to be included within the function and scope of sensor 48.

The third stop member 33 is made slidably movable (arrows 37 of FIG. 2) to aid in the removal or inspection of the misformed stack.

In the event that the last sheet of an otherwise proper stack is missed, both the stop members 31 and 32 may be raised for all or part of the next drum cycle. This is done to detect a miss that would in all probability go undetected. This partial or complete activation can be programmed into the collator by appropriate electronic means. The electronic programming is not a subject of this application, but is mentioned to provide a clearer understanding of the versatility of the invention.

Referring to FIG. 3c, an alternate embodiment is shown for the stopping members 31 and 32. Both the members 31 and 32 are movably pivotable at an angle with respect to the horizontal plane of the stacks. This is accomplished by angling shafts 35 and 41, and shaft 36 and 44 (not shown), respectively. Thus, when stopping members 31 and 32 move upwardly, they also pull away from the sheet edges of the stack. Member 32 is shown pulling away (arrow 57) from the stack as it moves upwardly (arrow 55). Member 31 acts in likewise fashion. This pulling away eliminates interference with the stack.

Thus, it has been shown, that a third off-set position is provided by this invention for an improperly collated stack of sheets, not inconsistent with the previously stated objects.

Naturally, many obvious modifications will occur to those skilled in this art. Such changes are hereby deemed to lie within the spirit and scope of this invention as presented by the appended claims.

What is claimed is:

1. A collator in combination with a stacking system having three off-set stack positions comprising:

a collating mechanism for feeding sheets of material to a stacking deck in a collated sequence;

a stacking deck for receiving sheets of material being fed thereto and for supporting said sheets in off-set stacks;

means defining a feed path along which the sheets are fed from said collating mechanism to said stacking deck;

error sensing means disposed along said feed path for sensing an improper feed condition of said sheet material being fed from said collating mechanism to said stacking deck; and a three position stop means disposed adjacent said stacking deck for stopping incoming sheets being received by said stacking deck and positioning said incoming sheets in off-set stacks, said stop means having first and second stop members alternately movable between a sheet stopping and a sheet non-stopping position, said second stop member being mounted with respect to the first stop member so as to be capable of stopping sheets when said first stop member is in the non-stopping position, said first and second stop members being operatively connected to said error sensing means and responsive to an improper feed condition sensed by said sensing means for selectively moving to said non-stopping position, such that both said first and second stop members are in their respective non-stopping positions when said sensing means senses an improper feed condition, and a third stop member for stopping sheet material when said first and second stop members are both in their respective non-stopping positions, whereby third offset sheet is provided for improperly fed sheet material without having to stop the collating mechanism.

2. The combination collator and stacking system of claim 1, wherein said error sensing means comprises a miss detector for detecting when a sheet of material has not been fed from the collating mechanism to said stacking deck.

3. The combination collator and stacking system of claim 1, wherein said error sensing means comprises a doubles detector for detecting when a double sheet of material has been fed from the collating mechanism to said stacking deck.

4. The combination collator and stacking system of claim 1, wherein said stacking deck has means for moving said deck so as to accommodate for the incoming sheets being accumulated in stacks thereon, and further comprising stack sensing means disposed adjacent said deck for sensing when said deck requires movement to accommodate for the incoming sheets, said stack sensing means being operatively connected to said deck moving means for actuating said stack moving means.

5. The combination collator and stacking system of claim 1, wherein said third stop member is movable from a sheet stopping position for manual removal of a defective stack of sheets.

6. The combination collator and stacking system of claim 1, wherein all of said stop members are movable away from, and biased towards, a sheet stopping position.

7. The combination collator and stacking system of claim 1, further comprising a programming means operatively connected to said first stop member for controlling the alternating movement of the first stop member between the sheet stopping and non-stopping positions.

8. A collator in combination with a stacking system having three off-set stack positions comprising:

sheet collating means for dispensing sheets of material in a collated sequence;

a stacking deck for receiving sheets of material from the collating means and supporting said sheets in off-set stacks;

means defining a feed path between said sheet collating means and said stacking deck;

error sensing means disposed along said feed path for sensing an improper feed condition for said sheet material being fed from said collating means to said stacking deck; and a three position stop means disposed adjacent said stacking deck for stopping incoming sheets being received by said stacking deck and positioning said incoming sheets in off-set stacks, said stop means having first and second alternating stop members that are each respectively movable between a stopping and a non-stopping sheet position, said second stop member being mounted with respect to the first stop member so as to be capable of stopping sheets when said first stop member is in the non-stopping sheet position, said first and second stop members being operatively connected and responsive to said error sensing means and both being in the respective non-stopping sheet positions when said sensing means senses an improper feed condition, and a third stop member for stopping sheet material when said first and second stop members are both in their respective non-stopping sheet positions, whereby a third off-set sheet position is provided for improperly fed sheet material without having to stop the collating means.

* * * * *